United States Patent [19]

Yasumoto

[11] Patent Number: 4,725,248

[45] Date of Patent: Feb. 16, 1988

[54] CONNECTOR FOR FLAT CABLE

[75] Inventor: Hiromi Yasumoto, Hitakamachi, Japan

[73] Assignee: Junkosha Co., Ltd., Japan

[21] Appl. No.: 900,780

[22] Filed: Aug. 27, 1986

[30] Foreign Application Priority Data

Sep. 3, 1985 [JP] Japan ..... 60-194622

[51] Int. Cl.[4] ..... H01R 9/08

[52] U.S. Cl. ..... 439/395; 439/499

[58] Field of Search ..... 339/176 MF, 176 M, 97 R, 339/97 P, 99, 17, 75 MP; 439/395, 499

[56] References Cited

U.S. PATENT DOCUMENTS

| | | | |
|---|---|---|---|
| 2,235,231 | 3/1941 | Mattis | 339/99 R |
| 3,605,073 | 9/1971 | Vetter | 339/99 R |
| 3,786,173 | 1/1974 | Vogt | 339/98 X |
| 4,084,878 | 4/1978 | Wahi | 339/99 R |
| 4,537,455 | 8/1985 | Verenten et al. | 339/99 R |

FOREIGN PATENT DOCUMENTS

| | | | |
|---|---|---|---|
| 2436889 | 2/1976 | Fed. Rep. of Germany | 339/98 |
| 968232 | 11/1950 | France | 339/99 R |
| 44-13331 | 6/1969 | Japan | 339/99 R |
| 1118573 | 7/1968 | United Kingdom | 339/99 R |
| 826466 | 4/1981 | U.S.S.R. | 339/99 R |

*Primary Examiner*—William R. Briggs

*Attorney, Agent, or Firm*—Mortenson & Uebler

[57] ABSTRACT

A connector for a flat cable having a plurality of conductors disposed parallel to and apart from each other within an insulator is provided, which connector comprises a cover having a channel adapted to support a terminal portion of said flat cable in a state wherein said terminal portion is bent, and a connector body having a plurality of contact terminals corresponding to the number of said conductors, said contact terminals extending through said connector body and being inserted into said bent terminal portion supported by said cover in such a manner that said contact terminals are in electrical contact with corresponding conductors, respectively, said connector body being adapted to clamp said cable having said contact terminals inserted thereinto between said connector body and said cover.

2 Claims, 2 Drawing Figures

CONNECTOR FOR FLAT CABLE

BACKGROUND OF THE INVENTION

This invention relates to a press contact type connector for a flat electrical cable.

One type of flat cable has heretofore been known which has parallel inner conductors and an insulator thereover and has on the outer surface thereof an electrically conductive or semi-conductive layer (hereinafter referred to as a "conductive layer") made of a metal foil or an electrically conductive plastic material, for either shielding purposes or in order to allow the conductive layer to serve as a common electrode. One type of conventional connector employed for connection of such cable has heretofore been arranged such that press contact type contact terminals, each having a bifurcated distal end portion, are inserted into the insulator in a flat cable in such a manner that the bifurcated distal end portion of each contact terminal straddles the corresponding conductor in the cable so as to be in electrical contact with the conductor.

In use of such a connector, because the conductive layer provided on, for example, the surface of the flat cable, is disposed in close proximity to the conductors inside the cable, it is necessary to prevent contact between the conductive layer and the contact terminals brought into contact with the conductors in the cable, and, for this purpose, it has heretofore been a general practice to partially remove the above-described conductive layer provided on the surface of the insulator before the bifurcated distal end portions of the contact terminals are inserted into the insulator.

However, because such shielding layer, e.g., a conductive layer, needs to be securely adhered onto the insulator so that it is not separated during use of the cable, it is a time-consuming operation to partially remove the shielding layer when connecting a conventional connector to the cable, and this disadvantageously leads to an increase in costs and also involves a lowering in electrical characteristics of the cable due to the removal of a part of the shielding layer.

In order to allow a connector to be connected to a shielded flat cable without the need to remove a part of the shielding layer such as a conductive layer which is provided on a terminal portion of the cable, it may be thought to increase the thickness of the insulator in the cable on the side thereof which is adjacent the shielding layer and insert the contact terminals of the connectors into the cable from the side thereof which is remote from the shielding layer. In such case, however, various problems are created. For example, the flexibility of the cable is decreased, and the cable becomes unsuitable for installation with a high packing density.

As other connecting means, connectors for a flat cable similar to the above have been disclosed in the specifications of Japanese Utility Model Publication Nos. 26518/1984 and 3185/1982. These connectors are arranged such that an insulating coating is applied to either the distal end portion or proximal portion of a bifurcated end portion of each contact terminal of a connector body so that, when the contact terminals are inserted into the insulator in a cable from the side thereof which is remote from the shielding layer, the contact terminals are insulated from the shielding layer but allowed to be in electrical contact with only the corresponding conductors. However, when the contact terminals are partially covered with an insulating coating so that, when the contact terminals contact the shielding layer, the former is prevented from conducting to the latter, it must be certain that an insulating coating is completely applied to each such terminal. In practice, however, it is difficult to completely apply an insulating coating to each such contact terminal, which means that a reduction in adhesion strength of the coating layer at, particularly, the edge portion of the bifurcated distal end of the contact terminal is usually unavoidable. In consequence, a portion of the coating layer which is necessary for insulation may be separated during a connecting operation, resulting in undesirable electrical contact between a contact terminal and the shielding layer on the cable. Therefore, this prior art is not necessarily satisfactory in terms of reliability. In addition, the necessity for an insulator coating operation disadvantageously leads to an increase in the production cost of such a connector.

Furthermore, the conventional press contact type connectors involve the problem that a contact failure may be caused when a tensile load acts on the cable.

It is an object of the present invention to solve the above-described problems of the prior art and provide a connector for a flat cable which is so designed so that the connector can readily be connected to the flat cable without lowering the electrical characteristics of the cable, and the connector can be produced economically.

SUMMARY OF THE INVENTION

A connector for a flat cable having a plurality of conductors disposed parallel to and apart from each other within an insulator is provided, which connector comprises a cover having a channel adapted to support a terminal portion of the flat cable in a state wherein the terminal portion is bent, and a connector body having a plurality of contact terminals corresponding to the number of conductors, the contact terminals extending through the connector body and being inserted into the bent terminal portion supported by the cover in such a manner that the contact terminals are in electrical contact with corresponding conductors, respectively, the connector body being adapted to clamp the cable having the contact terminals inserted thereinto between the connector body and the cover. Preferably, the channel is angled at substantially a right angle, the contact terminals being disposed in such a manner as to be inserted into the bent terminal portion between the conductors and the surface of the insulator in the bent distal end portion of the flat cable.

Figure 1:
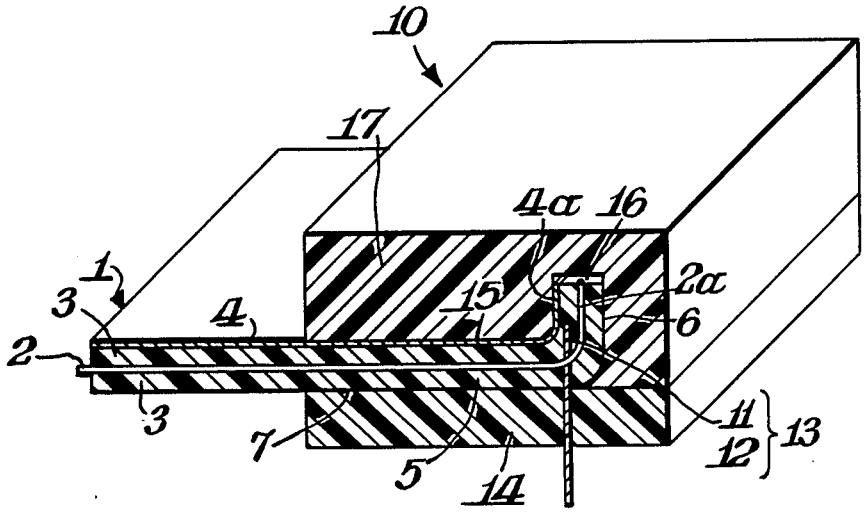
FIG. 1 is a perspective view of one embodiment of a connector according to the invention with one side thereof shown in cross section.

DETAILED DESCRIPTION OF THE INVENTION AND PREFERRED EMBODIMENTS WITH REFERENCE TO THE DRAWINGS

In view of the above-described problems of the prior art, the present invention provides a connector for a flat cable having a plurality of conductors disposed parallel to and apart from each other within an insulator, which comprises a cover adapted to support a terminal portion of the flat cable in a state wherein the terminal portion is bent, and a connector body having a plurality of contact terminals which are inserted into the bent terminal portion supported by the cover in such a manner that the contact terminals are in electrical contact with the conductors, respectively, the connector body being adapted to clamp the cable having the contact terminals inserted thereinto between the same and the cover.

In this arrangement, the cover preferably has a channel therein which is angled at substantially a right angle, and the contact terminals are preferably disposed in such a manner as to be inserted into the area between the conductors and the shielded surface of the insulator in the bent distal end portion of the flat cable, whereby the connecting operation is facilitated, and the contact terminals are stably brought into electrical contact with only the conductors.

According to the present invention, when a connector of the invention is used for connection of a flat cable having a shielding layer provided along an insulator surface, the distal end portion of a terminal part of the flat cable which is to be connected to the connector is bent by means of the angled channel provided in the cover, and the contact terminals of the connector body are inserted into the cable from the side thereof which is remote from the bent distal end portion in such a manner that the contact terminals extend substantially parallel to the bent distal end portion, thereby bringing the conductors in the cable and the corresponding contact terminals into electrical contact with each other, respectively. Accordingly, the contact terminals of the connector body enter the insulator in the bent portion of the flat cable in such a manner as to extend substantially parallel to and away from the shielding layer, so that the contact terminals of the connector body are prevented from contacting the shielding layer.

Accordingly, the connector can be connected to a flat cable in a single step without the need to remove the shielding layer at the terminal part of the cable, which has heretofore been required. Therefore, the electrical characteristics of the cable are not deteriorated, and the connecting operation is facilitated. In addition, because it is unnecessary to apply an insulating coating to the contact terminals, the connector can be produced economically. Thus, the present invention offers great practical advantages.

When the connector of the present invention is employed for connection of a flat cable having no shielding layer, because the terminal part of the cable is supported in such a manner that it is bent, the conductors are not displaced or offset by a tensile load applied to the cable, even when the force of the connector for clamping the cable has been lowered. Thus, the connector of the present invention is advantageously stable.

In FIG. 1 is shown a fragmentary sectional side view of a connector 10 for a flat cable according to the present invention in use. Flat cable 1 has a conventionally known structure. More specifically, a plurality of conductors 2 which are disposed parallel to and apart from each other are embedded in an insulator 3, and an electrically conductive or semi-conductive shielding layer 4 is provided on one surface of the insulator 3 for shielding purposes or in order to allow the layer 4 to serve as a common electrode.

This connector 10 comprises a connector body 14 having contact terminals 13 each provided so as to be substantially coincident with each of the conductors 2 in the flat cable 1, each contact terminal 13 having at one end thereof a bifurcated conductor contact portion 11 with two pointed ends so that it can be inserted into the insulator 3 in the flat cable 1, and at the other end a contactor portion 12, a clamping member 15 engaged with the connector body 14 in such a manner as to clamp a terminal part 5 of the flat cable 1 between the same and the connector body 14, and a cover 17 having an angled channel 16 which is contiguous with the clamping member 15 and adapted to bend the distal end portion 6 of the flat cable 1 toward the shielding layer 4 at right angles.

Figure 2:
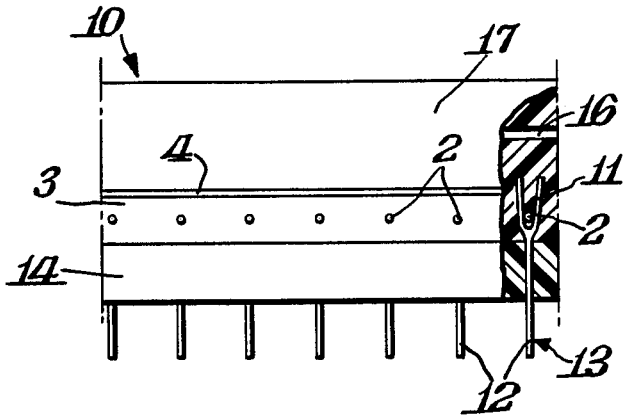
FIG. 2 is a front elevation, partly broken away, of the cable and connector, showing bifurcated contact terminals in contact with conductors shown in the broken-away portion.

To connect the above-described connector 10 according to the present invention to the flat cable 1, the distal end portion 6 of the terminal part 5 of the cable 1 is first fitted into the angled channel 16 provided in the cover 17 of the connector 10, and the terminal part 5 is then bent at right angles along the clamping member surface 15. At this time, the cable 1 is disposed in such a manner that the shielding layer 4 faces the clamping member surface 15 of the cover 17. Then the connector body 14 is disposed in such a manner that the bifurcated conductor contact portion 11 of each of the contact terminals 13 faces the surface 7 of the cable 1 on which no shielding layer 4 is provided and, at the same time, the center of the bifurcated conductor contact portion 11 of each contact terminal 13 is coincident with the corresponding conductor 2 in the cable 1. In this arrangement, the connector body 14 is pressed in such a manner that the conductor contact portions 11 are inserted into the cable 1, and the connector body 14 is engaged and thereby connected with the cover 17 with the cable 1 clamped therebetween. At this time, the bifurcated conductor contact portion 11 of each of the contact terminals 13 of the connector body 14 is inserted into the insulator 3 in the cable 1 and allowed to straddle the corresponding conductor 2 in the cable 1 so as to be brought into electrical contact with the latter, as shown in FIG. 2. In this case, the distal end portion 6 of the cable 1 is bent at right angles by the angled channel 16 of the cover 17, and the contact terminals 13 of the connector body 14 are provided so that they extend parallel to the angled channel 16 and the respective bifurcated conductor contact portions 11 of the contact terminals 13 are positioned between the shielding layer 4a and the conductors 2a in the bent distal end portion 6 of the cable 1. For this reason, the contact terminals 13 do not contact the shielding layer 4a in the cable 1, and the contact terminals 13 and the shielding layer 4a are therefore effectively insulated from each other.

Although the contact terminals 13 are provided in the connector body 14 so that the distal end of the conductor contact portion 11 of each contact terminal 13 is positioned between the shielding layer 4a and the conductors 2a of the bent distal end portions 6 of the cable 1, the relative position between the angled channel 16 of the cover 17 and the contact terminals 13 of the connector body 14 may be changed. For example, the contact terminals 13 and the conductors 2a may be positioned such as to be flush with each other so that the proximal portion of each of the bent conductors 2a in the distal end portion 6 of the cable 1 is clamped to the bifurcated conductor contact portion 11 of the corresponding contact terminal 13. Alternatively, the arrangement may be such that the bifurcated conductor contact portion 11 of each contact terminal 13 clamps both the corresponding conductor 2 and bent conductor 2a.

As has been described above, according to the present invention, the distal end portion of a terminal part of a flat cable which is to be connected to the connector is bent by the angled channel provided in the cover, and the contact terminals of the connector body are inserted into the cable from the side thereof which is remote from the shielded surface of the bent distal end portion thereof in such a manner that the contact terminals extend substantially parallel to the bent distal end portion, thereby bringing the contact terminals and the conductors in the cable into electrical contact with each other. Thus, the connector can be connected to the flat cable in a single step without the need to remove the shielding layer at the terminal part of the cable, which has heretofore been required. In consequence, it is possible to prevent any decrease of the electrical characteristics of the cable, and the connecting operation is facilitated, which means that the present invention offers great practical advantages. In addition, since it is unnecessary to apply an insulating coating to the contact terminals, the connector can be produced economically. Further, the connector according to the present invention does not require that a portion of the insulating coating, which is necessary for insulation, being separated to cause the contact terminals to electrically contact the shielding layer as in the case of the prior art, the reliability of the connector of the invention is advantageously high. Furthermore, the connector is adapted to support the cable in a state wherein, for example, the distal end portion of the cable is bent. It is therefore possible to support the cable in such a manner that the electrical contact between the conductors in the cable and the contact terminals of the connector is stably maintained even when a tensile load acts on the cable.

It should be noted that the present invention is not necessarily limited to the above-described embodiment, and various changes and modifications may, of course, be imparted thereto without departing from the technical scope of the invention. For example, either one or both of the angled channel and the contact terminals may be provided at an angle other than 90°. A plurality of angled channels may be provided. In addition, the relative position therebetween may be changed, or other members may be additionally provided.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A connector for a shielded flat cable, said cable having a plurality of conductors disposed parallel to and apart from each other within an insulator, said cable having a shielding layer on one side thereof, which connector comprises a cover having a channel adapted to support a terminal portion of said flat cable in a state wherein said terminal portion is bent, said shielding layer being in adjacent contact with said cover, and a connector body having a plurality of bifurcated contact terminals corresponding to the number of said conductors in said shielded cable, said contact terminals extending through said connector body and being inserted into said bent terminal portion supported by said cover through the unshielded side of said shielded flat cable in such a manner that said contact terminals are in electrical contact with corresponding conductors, respectively, said connector body being adapted to clamp said cable having said contact terminals inserted thereinto between said connector body and said cover.

2. A connector for a flat cable according to claim 1, wherein said channel is angled at substantially a right angle, said contact terminals being disposed in such a manner as to be inserted into said bent terminal portion between said conductors and the surface of said insulator in the bent distal end portion of said flat cable.

* * * * *